United States Patent [19]

Schelle

[11] 4,146,143

[45] Mar. 27, 1979

[54] AUTOMATIC COUPLER FOR RAILWAY VEHICLES

[75] Inventor: Axel Schelle, Rottach-Scherfen, Fed. Rep. of Germany

[73] Assignee: Knorr-Bremse GmbH, Munich, Fed. Rep. of Germany

[21] Appl. No.: 835,861

[22] Filed: Sep. 23, 1977

[30] Foreign Application Priority Data

Mar. 30, 1977 [DE] Fed. Rep. of Germany ..... 2714185

[51] Int. Cl.[2] ..... B61G 3/00

[52] U.S. Cl. ..... 213/152; 213/151

[58] Field of Search ..... 213/109, 110, 113, 151, 213/152, 153, 154

[56] References Cited

U.S. PATENT DOCUMENTS 2,361,850 10/1944 Kinne ..... 213/153

2,719,634 10/1955 Metzger ..... 213/153

2,772,791 12/1956 Wolfe ..... 213/152

*Primary Examiner*—Trygve M. Blix

*Assistant Examiner*—D. W. Keen

*Attorney, Agent, or Firm*—Edmund M. Jaskiewicz

[57] ABSTRACT

An automatic coupler of the Janney-type has a guide horn rigidly connected to the coupling head below the knuckle and extends forwardly and laterally with respect to the knuckle. The guide horn is shaped to have on its upper face a plurality of guide and support surfaces. A second plurality of guide and support surfaces are formed on the underside of the rigid catch jaw which is spaced horizontally from the pivotable knuckle. The guide surfaces on the guide horn and underside of the jaw engage respectively guide surfaces on the underside of the jaw and a guide horn of a similar coupler when such couplers are in the coupled position so as to prevent relative vertical displacement of the coupled coupling heads.

5 Claims, 4 Drawing Figures

AUTOMATIC COUPLER FOR RAILWAY VEHICLES

The present invention relates to an automatic coupler for railway vehicles of the Janney-type, more particularly, to such a coupler which provides for automatic connection of supply lines including air and electrical lines.

The Janney or AAR coupler is in general use on railroads in the United States and Japan. Such a coupler generally comprises a coupling head having a rigid catch jaw and horizontally spaced from the jaw is a knuckle which is pivotable about a vertical axis so as to define a coupling mouth between the jaw and knuckle. The knuckle is pivotable through an angle of about 90° between an outwardly extending coupling position and an inwardly pivoted coupled position in which position it is locked by a manually operable latch.

Such couplers are not rigid since the coupling heads of successive coupled vehicles are capable of vertical displacement with respect to each other. The horizontal central axes of coupling heads on differently loaded vehicles will thus be spaced from each other. Further, these couplers do not permit automatic and simultaneous coupling of air, electrical or other supply lines. Such lines must be connected by hand and thus these automatic couplers incorporate the disadvantages of the so-called screw-couplers.

It has been proposed to provide lateral funnels and cams on such Janney couplers in order to increase the gripping range. When the coupling heads of such couplers are displaced vertically or angularly and abut each other at the beginning of a coupling operation, the funnels and cams will reciprocally align the coupling heads and thus prevent a collision of those portions of the coupling heads which would prevent coupling engagement of the couplers. The provision of such funnels and cams are unsatisfactory in that they do not permit an automatic simultaneous coupling of supply lines and the width dimensions of the coupling heads are significantly increased because of the laterally attached funnels. The increase in dimension alone is a significant disadvantage in view of the limited space available in the vicinity of couplers on railway vehicles.

Another known form of coupler is known as the automatic central buffer coupler having a coupling head with a rigid impact member and a rigid traction member. Such a coupler which is known as the Willison coupling is a rigid coupling which permits the simultaneous coupling of air and other supply lines.

The rigid connection of the coupling heads is achieved by providing a guide horn below the thrust member and this horn engages the underside of a traction member of the counter-coupling head to thus prevent relative vertical displacement of the coupling heads after they have been coupled. However, such coupling heads cannot be coupled to the abovementioned Janney coupling heads.

It is therefore the principal object of the present invention to provide an improved Janney coupler which will enable the automatic connecting of air and other supply lines.

It is a further object of the present invention to provide such a Janney coupler so as to achieve the result of a rigid coupler and to permit the automatic simultaneous coupling of air and other supply lines.

According to one aspect of the present invention such an automatic coupler for railway vehicles may comprise a coupling head having a knuckle pivotable about a vertical axis and a rigid catch jaw spaced horizontally from the knuckle so as to form a coupling mouth therebetween. The knuckle is pivotable outwardly into a coupling position and pivotable 90° inwardly into a coupled position in which it is locked by means of a latch. A guide horn is rigidly connected to the coupling head below the knuckle and extends outwardly and forwardly with respect to the knuckle. The guide horn has a plurality of guide and support surfaces thereon. A second plurality of guide and support surfaces are formed on the underside of the catch jaw. The first and second pluralities of guide and support surfaces engage respectively second and first pluralities of guide and support surfaces on a similar coupler in the coupled condition so as to prevent relative vertical displacement of the coupled coupling heads.

The guide and support surfaces on the guide horn and underside of the rigid jaw are formed to guide into the coupled position the jaw and guide horn of a coupling head of a counter-coupler during the coupling operation. These guide and support surfaces on the guide horn and the underside of the jaw thus permit a definite vertical and horizontal positioning of the two coupling heads which have to be connected to each other. The supply lines are located in suitable passages below the coupling mouths and are automatically connecting on abutment of the coupling heads. As result, it is possible to eliminate manual coupling of the supply lines during coupling of railway vehicles.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
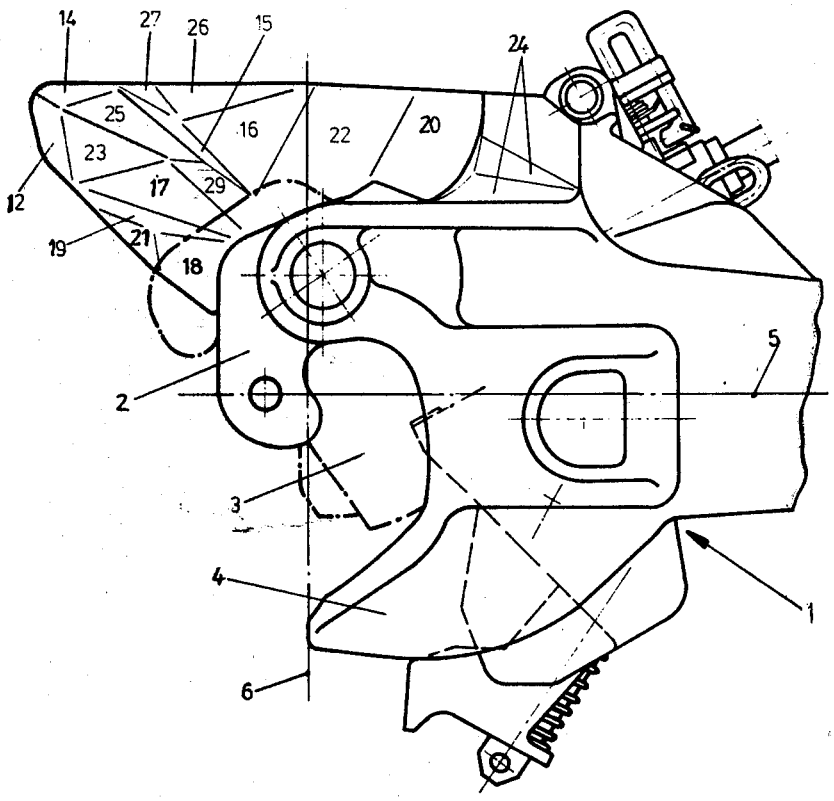
FIG. 1 is a top plan view of the automatic coupler according to the present invention.

In FIG. 1, there is indicated generally at 1 a coupling head of a central buffer coupler constructed as a rigid coupler according to the present invention. The coupling head 1 has a knuckle 2 which is pivotable through an angle of about 90° about a vertical axis and is illustrated in FIG. 1 in the coupled position. A rigid catch jaw 4 is spaced horizontally from the knuckle 2 to define a coupling mouth 3 therebetween. The knuckle 2 and the jaw 4 thus jointly form a coupling profile employed for the purpose of a positive coupling of two similar central buffer couplers as disclosed herein.

The central longitudinal axis of the coupling head 1 is indicated at 5 and a traction or draw bar only a portion of which is indicated in FIG. 1 extends along the axis 5. Perpendicularly to the axis 5 the coupling head 1 has a coupling plane 6 which extends transversely of the coupler and passes along the forward edge of the rigid jaw 4 and inner surface of the knuckle 2 as may be seen in FIG. 1. During a coupling operation, two couplers of the type disclosed herein enter into an interlocking connection along the coupling plane 6.

When two coupling heads such as 1 abut against each other, the knuckle 2 is pivoted into its locked or coupled position as shown in FIG. 1 under the action of the jaw of the other coupling head. The knuckle 2 is then locked in its coupled position by means of a dropping latch which is not shown in the drawing but is known in the art. For uncoupling, the latch is lifted by a suitable operating rod as also known in the art to unlock the knuckle. When two railway vehicles are uncoupled and separated, the knuckles 2 of their respective coupling heads will be pivoted outwardly into the positions as shown by the dashed lines of FIG. 1 so that the coupler is ready for a coupling operation. However, if both knuckles are located in the coupled or locked position coupling is not possible.

A rigid guide horn 7 is fixedly connected to the coupling head 1 below the knuckle 2 and projects forwardly and laterally outwardly, as can be seen in FIG. 1, to project beyond the knuckle 2. When viewed from about as in FIG. 1, the guide horn 7 has a substantially rhomboidal shape and has an inner vertical impact surface 10 extending in the direction of thrust and this surface is at an angle of about 45° with respect to the longitudinal axis 5 of the coupler so as to define substantially equal angles with the longitudinal axis 5 and coupling plane 6. The impact surface 10 is oriented or faces toward the center of the coupler. The outer lateral surface of the guide horn 7 is defined by an outer vertical surface 13 which is substantially parallel to the longitudinal axis 5 of the coupler and extends rearwardly past the coupling plane 6. The forward edge of the guide horn 7 comprises a rounded surface which provides a transition between the inner surface 10 and outer surface 13.

As viewed from the front or from the side of the coupler having the knuckle 2, the upper portion of guide horn 7 is defined by two substantially horizontal supporting surfaces 20 and 22 that are located within the range of engagement of the catch jaw of a countercoupler and extend to the knuckle 2 so as to engage the underside of a jaw 4 of a similar coupler having the same coupling profil. The rearmost supporting surface 20, as viewed in the direction of thrust, is followed by two steeply upwardly and rearwardly extending inclined guide surfaces 24 that define an acute angle on the coupling head.

The guide horn 7 has a bottom substantially trapezoidal positioning surface 26 which is disposed substantially horizontally similar to supporting surface 20. An inclined surface 27 rises forwardly and outwardly from the bottom surface 26 and a more steeply inclined surface 28 extends forwardly and upwardly from surface 27.

The upper face of the guide horn 7 proceeding from the longitudinal axis of the coupler includes an upwardly and outwardly inclined guide surface 18 positioned below a portion of the frontal face of the knuckle 2 and ending in the area of the boundary between the front and lateral surfaces of the knuckle 2. Extending from guide surface 18 is a steeper inclined substantially triangular lateral guide surface 19. Between the inner impact surface 10 and an edge of the guide surface 19 as well as an edge of guide surface 18 there is a substantially triangular guide surface 21 which forms a transition between the inner impact surface 10 and both guide surfaces 18 and 19.

One edge of the guide surface 18 ends in direction of thrust at the inner impact surface 10. The guide surface 19 adjoins a substantially triangular supporting surface 17 whose obtuse angled tip is positioned opposite the coupling edge to guide surface 19. The supporting surface 17 is disposed in a manner as pivoted forwardly and downwardly about an imaginary level on the coupling edge to the guide surface 19. Adjacent an edge of supporting surface 17 which is the forward edge as viewed in the direction of thrust there is an acute angle supporting surface 23 which is inclined forwardly and downwardly. Laterally adjacent supporting surface 23 and toward the outer surface of the coupler is a trapezoidal supporting surface 25.

The common edge line between supporting surfaces 23 and 25 extends to a common centering point A which is located laterally in front of the knuckle 2 approximately in the center of the guide horn 7. This common edge line between surfaces 23 and 25 is approximately in the top center of the guide horn 7 and extends downwardly in a forward direction with respect to the direction of thrust. Below the base lines of the supporting surfaces 23 and 25 there are positioned more steeply inclined surfaces 12 and 14 which provide a gradual transition to the rounded transition surface between the inner lateral face 10 and the outer lateral face 13.

Proceeding rearwardly from centering point A an upwardly inclined trapezoidal supporting surface 29 is positioned between a rear edge as seen in the direction of thrust of supporting surface 20 and the edge of trapezoidal guide surface 25 which similarly extends from the centering point A. A rear edge of supporting surface 29 adjoins the only slightly inclined supporting surface 22 on one hand and on the other hand on a downwardly inclined surface 15 which forms a flank of a reshaped groove or recess cut into the upper surface of the guide horn 7. A supporting surface 16 forms another flank of the groove and is positioned rearwardly of the groove as seen in the direction of thrust. The surface 16 rises in the direction of the central axis of the guide horn and is adjacent to the substantially hroizontal supporting surface 22. At the outer lateral surface 13 of the guide horn, the groove or recess has its end widened by means of two triangular guide surfaces 26' and 27. The longitudinal axis of the groove or the intersecting edge between the trapezoidal surface 15 and rear groove flank 16 is oriented approximately in parallel with the inner impact vertical surface 10.

The edge lines between guide surfaces 18 and 19 as well as between guide surface 19 and supporting surface 17 as well as the line between supporting surface 17 and trapezoidal surface 29 all converge at a point located just below the knuckle 2. The guide surfaces 17, 23, 25 and 29 also converge at the centering point A to define a substantially pyramid-shape.

On the front lower portion of the coupling head 1 there is a guide wall 31 which extends in a direction substantially parallel to the inner impact surface 10 and projects laterally beyond the width of the coupling head 1 as may be seen in FIG. 1. The lower edge of the coupling head is formed by a guide ridge or cross piece 30 which interconnects guide wall 31 to the inner impact surface 10 and thus closes an opening which is underneath the coupling mouth 3. The opening contains various pipelines such as air or electricity which can be coupled to a central buffer coupler.

Figure 2:
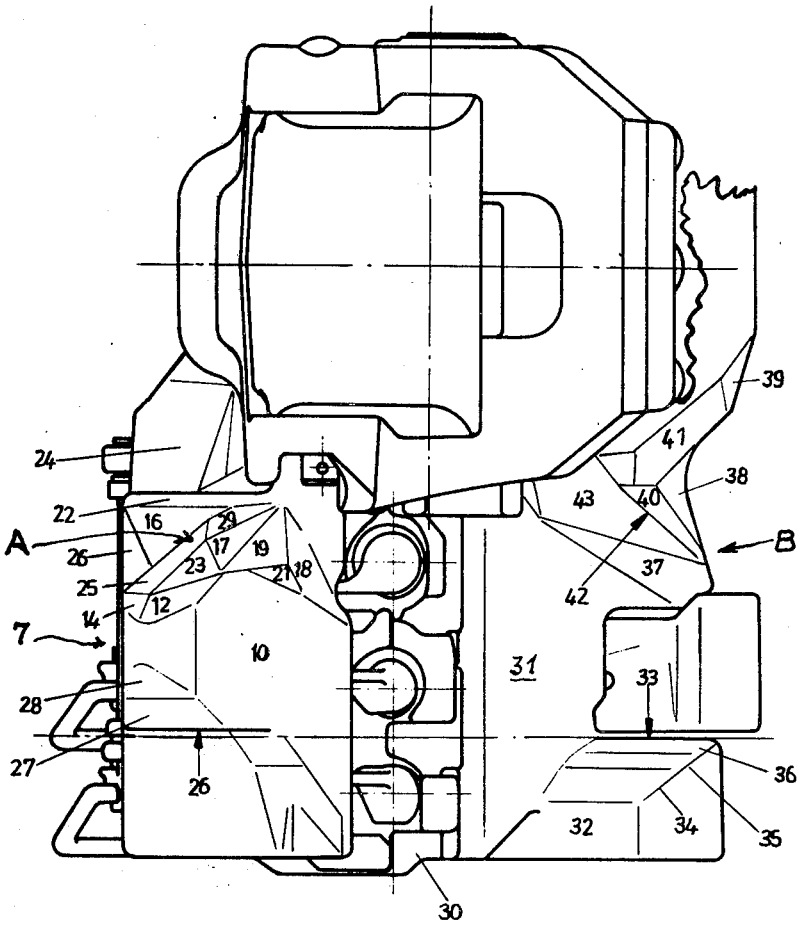
FIG. 2 is a front elevational view of the coupler of FIG. 1.
Figure 3:
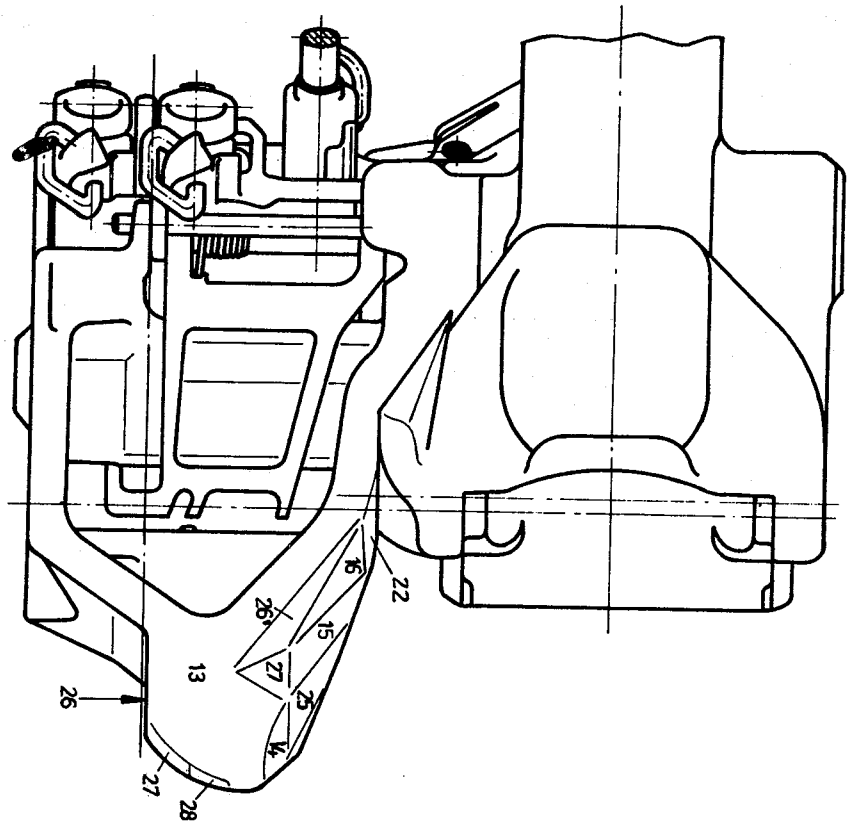
FIG. 3 is a side elevational view viewed from the side of the coupler having the movable knuckle.
Figure 4:
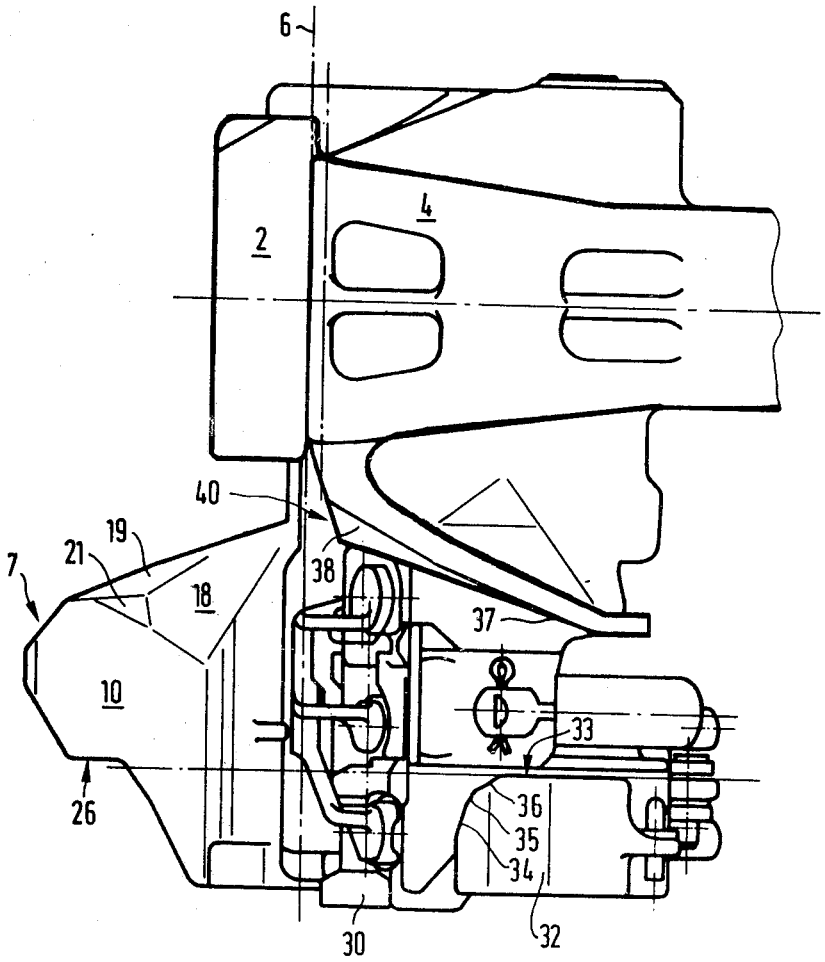
FIG. 4 is side elevational view of the coupler viewed from the opposite or fixed jaw side thereof.

On the rear lower portion of guide wall 31 there is a projection 32 which protrudes perpendicularly from the guide wall and which has a top horizontal surface 33 which defines a plane together with the lower positioning surface 26 of the guide horn 7 as may be seen in FIG. 2. The projection 32 is positioned below the rigid catch jaw 4 and is provided with a plurality of progressively inclined guiding surfaces 34, 35 and 36 all of which are perpendicular to the guide wall 31.

The projection 32 is positioned to engage the underside of a guide horn of a similar coupling head which is to be coupled thereto. The guide horn is provided with a recess on its underside defined by its surface 26 which corresponds in shape to the projection 32. The interengagement prevents relative turning of the coupling heads with respect to each other about their longitudinal axes since the bottom surface of the catch jaw is held by the projection 32 in constant contact with the upper surface of the guide horn on the counter coupling head.

Spaced at a distance above the plane formed by the lower surface 26 of the guide horn 7 and the upper surface 33 of the projection 32 and corresponding to the deepest point of the groove or recess on the upper surface of guide horn 7, there is a lower surface 37 of the catch jaw 4 which surface projects from the guide wall 31 forwardly in the direction of thrust and is positioned vertically above the top surface 33 of projection 32. With respect to the rear flank 16 of the groove on horn 7, the catch jaw lower surface 37 is inclined in the opposite direction and will be overlapped by the flank 16 through engagement from below when in interlocking connection with a counter coupler.

A forward and lateral limiting point of the jaw lower surface 37 is disposed on the laterally outer boundary of the jaw and defines a second centering point B. Proceeding forwardly from centering point B, a rear lateral guide surface 38 extends forwardly and upwardly with respect to the direction of thrust and bevels or inclines the jaw 4 in the outer direction. The surface 38 then passes into a steeper inclined upwardly oriented forward lateral guide surface 39. The front central portion of the jaw 4 in the direction of thrust is provided with a substantially triangular central guide surface 40 which inclines upwardly in the forward direction and terminates in a face guide surface 41 which also bevels or slopes the face of the jaw 4.

Extending from the central guide portion 40 is an inner gripping surface 42 which is oriented toward the coupling mouth 3 and is similarly inclined in a rising direction. The interconnection between the surface 42 and guide wall 31 projecting perpendicularly from the lower side of the coupling head forms a rear surface 43 which beginning on the lower surface 31 of the jaw 4 extends upwardly into the area of the coupling mouth 3 and thus inclines the lower face of jaw 4 inwardly in this area.

The guiding and supporting surfaces on the underside of the jaw 4 are characterized in that the common edge lines formed by the separate reciprocally adjacent surfaces such as between rearguide surface 38, central guide portion 40, inner gripping surface 42, rear surface 43 and jaw lower surface 37 terminate at the common centering point B. The centering point B is also positioned at a forward and lateral externally located edge of the jaw lower surface 37. As result of this structure, the coupling heads in shifted reciprocal abutment are centered and aligned gradually and step-by-step so that one avoids excessive surface pressures and wear on separate points of the abutting couplers.

The recess formed by the groove on the upper surface of the guide horn 7 thus facilitates coupling with a similar counter central buffer coupling having the same coupling profile or outline should these two couplers be shifted laterally and vertically with respect to each other. During the coupling operation, the catch jaw of the counter-coupling because of the groove on the horn will initially reach the area of the groove with its edge oriented in the direction of the longitudinal axis of the coupler. Thus, a contact which may prevent coupling will not occur. The surfaces 12 and 14 arranged on the upper portion of the guide horn 7 will cause a reciprocal alignment of the coupling heads in the area below the coupling mouth of the counter-coupling and subsequently also in engagement with the trapezoidal surface 29 and supporting surfaces 22 and 20 so as to guide the coupling heads together into an interlocking connection.

When two couplers which are displaced vertically with respect to each other abut against each other at the beginning of a coupling operation, gripping surfaces 27 and 28 on one coupler will engage opposite projection 32 on the counter-coupler to bring about an alignment of the couplers.

It is thus apparent that with respect to the non-rigid couplers of the type described in the prior art, the central buffer coupler according to the present invention has the advantages of an increased range of gripping, of much improved protection for the coupling or connecting of air or other supply lines and of having a much narrower profile so as to occupy a minimum of space at the end of a railway vehicle.

It will be understood that this invention is susceptible to modification in order to adapt it to different usages and conditions, and accordingly, it is desired to comprehend such modifications within this invention as may fall within the scope of the appended claims.

What is claimed is:

1. An automatic coupler for railway vehicles comprising a coupling head having a rigid catch jaw and a knuckle pivotable about a vertical axis spaced horizontally from said jaw to define a coupling mouth therebetween, said knuckle being pivotable outwardly in a coupling position and pivotable 90° inwardly into a coupled position, latch means for locking said knuckle in its coupled position, a guide horn rigidly connected to said coupling head below said knuckle and extending forwardly and laterally outwardly with respect to said knuckle, said guide horn having a plurality of guide and support surfaces thereon, there being a second plurality of guide and support surfaces on the underside of said catch jaw, said first and second pluralities of guide and support surfaces engaging resqectively second and first pluralities of guide and support surfaces of a similar coupler in the coupled state to prevent relative vertical displacement of the coupled coupling heads, and a projection from said coupling head spaced below said jaw and having a horizontal top surface, said projection having a plurality of progressively sloping surfaces from the forward portion of the projection to the top surface thereof, said projection being engageable with the underside of a guide horn of a similar coupler in the coupled position.

2. An automatic coupler as claimed in claim 1 wherein said guide horn has a vertical impact surface at an oblique angle to the longitudinal axis of the coupler, there being a guide wall on said coupling head below said jaw extending substantially parallel to said vertical impact surface, said projection extending from a rear lower portion of said guide wall and said sloping surfaces and top surface of said projection being substantially perpendicular to said guide wall.

3. An automatic coupler as claimed in claim 2 wherein said vertical impact surface extends in the direction of thrust on said guide horn and faces toward the center of the coupler, said coupler having a coupling plane passing along the outer edge of said jaw and the inner surface of said knuckle when in the coupled position, said coupling plane being transverse to the longitudinal axis of the coupler, said vertical impact surface defining equal angles with the longitudinal axis and coupling plane of said coupler.

4. An automatic coupler as claimed in claim 2 wherein said guide horn has an outer lateral vertical surface (13) and there being a rounded transition surface between said inner and outer vertical surfaces at the forward end of said horn, a plurality of triangular guide surfaces radiating from a centering point on the upper surface of said guide horn to define a pyramid and comprising a first guide surface (17) extending toward said inner vertical surface (10), a second guide surface (29) extending rearwardly and upwardly with respect to the direction of thrust, a third surface (23) extending forwardly with respect to the thrust toward the inner vertical surface (10), and a fourth surface (25) extending forwardly toward the outer vertical surface (13), a second plurality of fifth, sixth and seventh triangular guide surfaces (18, 19, 21) extending from the base of said first guide surface (17) to define a gradual transition to said inner vertical surface (10), eighth (12) and nineth (14) guide surfaces extending forwardly and downwardly from said third and fourth surfaces to define a gradual transition to said rounded forward transition surface, a tenth guide surface (22) extending rearwardly and substantially horizontally from said second guide surface (29), eleventh (15) and twelfth (16) guide surfaces defining a V-shaped groove between said tenth and said fourth surfaces and said groove being substantially parallel to said inner vertical impact surface (10), thirteenth (26') and fourteenth (27) guide surfaces at the forward end of said groove to widen said forward end, a fifteenth (20) guide surface extending rearwardly and substantially horizontally from said tenth surface, and sixteenth and seventeenth guide surfaces (24) extending steeply upwardly and rearwardly from said fifteenth surface, the underside of said catch jaw having an eighteenth guide surface (37) projecting from said jaw guide wall (31) and being at the same level as said twelfth guide surface (16) and inclined oppositely therefrom, said eighteenth guide surface being disposed vertically above said projection and having a forward and lateral corner thereof to define a second centering point (B), a nineteenth guide surface (38) rising forwardly and outwardly from said eighteenth surface, a twentieth guide surface (39) extending steeply forwardly and laterally from said nineteenth surface, a twenty-first triangular guide surface (40) on the forward portion of said jaw and extending steeply forwardly and upwardly, a twenty-second guide surface (41) extending steeply upwardly and forwardly from said twenty-first surface at the forward portion of said jaw, a twenty-third guide surface (42) rising inwardly toward the coupling mouth on the underside of said jaw, and a twenty-fourth guide surface (43) extending upwardly from said eighteenth surface toward the coupling mouth, said eighteenth, twenty-third and twenty-fourth surfaces having common edge lines terminating at said second centering point.

5. An automatic coupler as claimed in claim 1 wherein the lower surface of said guide horn has recess shaped to conform to said projection.

* * * * *